US005804926A

United States Patent [19]

Deavenport

[11] Patent Number: 5,804,926

[45] Date of Patent: Sep. 8, 1998

[54] LIGHTING CIRCUIT THAT INCLUDES A COMPARISON OF A "FLATTENED" SINEWAVE TO A FULL WAVE RECTIFIED SINEWAVE FOR CONTROL

[75] Inventor: Joe E. Deavenport, San Diego, Calif.

[73] Assignee: Raytheon Company, Lexington, Mass.

[21] Appl. No.: 629,325

[22] Filed: Apr. 8, 1996

[51] Int. Cl.[6] ..... H05B 37/02

[52] U.S. Cl. ..... 315/219; 315/307; 315/DIG. 7; 315/DIG. 4; 315/208

[58] Field of Search ..... 315/219, 247, 315/307, DIG. 7, DIG. 4

[56] References Cited

U.S. PATENT DOCUMENTS 4,251,752 2/1981 Stolz ..... 315/247
4,277,728 7/1981 Stevens ..... 315/247

*Primary Examiner*—Robert Pascal
*Assistant Examiner*—Michael Shingleton
*Attorney, Agent, or Firm*—Leonard A. Alkov; Glenn H. Lenzen, Jr.

[57] ABSTRACT

A gas discharge lamp electronic ballast circuit including a gas discharge lamp (51); a rectifier circuit (11*a*, 11*b*, 11*c*, 11*d*, 13) responsive to AC power for providing a full wave rectified sinewave voltage across output terminals of the rectifier circuit; a transformer (T1) having a primary winding and a secondary winding; a switching circuit (29) for repetitively connecting the rectifying circuit full wave rectified sinewave voltage to the primary winding; a driving circuit (33, 35, 37, T2, 49) responsive to the secondary winding for driving the lamp with a sinusoidal voltage having a predetermined frequency; a current sensing circuit (39, 41, 45, 47, 43) for sensing an average of peaks of current flowing in the driving circuit; and a pulse width modulation circuit (25) responsive to the full wave rectified sinewave voltage and the current sensing means for pulse width modulating the switching circuit at the predetermined frequency such that the rectifier circuit provides a current having a flattened full wave rectified sinewave waveform.

4 Claims, 2 Drawing Sheets

LIGHTING CIRCUIT THAT INCLUDES A COMPARISON OF A "FLATTENED" SINEWAVE TO A FULL WAVE RECTIFIED SINEWAVE FOR CONTROL

BACKGROUND OF THE INVENTION

The disclosed invention is generally directed to power supplies for switching ballasts for gas discharge lamps such as fluorescent lamps, and more particularly to a power supply that provides for improved power factor and lamp efficiency.

Fluorescent lighting systems are utilized for illumination in a wide variety of localized and general area lighting applications. These include residential, office, and factory lighting as well as work lights, back lights, display illumination and emergency lights.

Known fluorescent lighting systems typically comprise a fluorescent lamp, an AC to DC power supply, and a switching ballast responsive to the power supply for driving the fluorescent lamp. Considerations with fluorescent lighting systems include the desire for high power factor whereby the time varying AC current input to the power supply tracks the time varying AC voltage input to the power supply, the desire for lamp efficiency wherein the amount of time the lamp is deionized is kept at a minimum, and the desire for low crest factor of the lamp current for maximum lamp life, wherein crest factor is the ratio of peak lamp current to RMS lamp current.

With known fluorescent light systems that include an AC to DC power supply and a switching ballast, low crest factor is readily achieved by including a smoothing filter capacitor on the DC side of the AC to DC power supply which holds the rectified DC voltage at or near the peak of the AC input such that the rectified DC voltage has only a small amount ripple. However, the power factor of such a system would be poor since the smoothing capacitor is charged only at the peaks of the input AC voltage is near or at it, and thus the AC input current flows only for a short time intervals at relative large amplitudes. In other words, the AC input current waveform comprises current spikes if a filter capacitor is utilized to provide a smooth rectified DC voltage having only a small amount of ripple. At the other extreme, omission of a smoothing filter capacitor on the DC side of the AC to DC power supply results in high power factor, but unacceptably high crest factor in the lamp current of switching ballasts as well as reduced efficiency.

SUMMARY OF THE INVENTION

It would therefore be an advantage to provide an improved gas discharge lamp electronic ballast circuit that provides for improved power factor, low crest factor, and high lamp efficiency.

Another advantage would be to provide an improved gas discharge lamp electronic ballast circuit that provides for improved power factor, low crest factor, and high lamp efficiency at relatively low cost and a lower parts count.

The foregoing and other advantages are provided by the invention in a gas discharge lamp electronic ballast circuit that includes a gas discharge lamp; a rectifier circuit responsive to AC power for providing a full wave rectified sinewave voltage across output terminals of the rectifier circuit; a transformer having a primary winding and a secondary winding; a switching circuit for repetitively connecting the rectifying circuit full wave rectified sinewave voltage to the primary winding; a driving circuit responsive to the secondary winding for driving the lamp with a sinusoidal voltage having a predetermined frequency; a current sensing circuit for sensing an average of peaks of current flowing in the driving circuit; and a pulse width modulation circuit responsive to the full wave rectified sinewave voltage and the current sensing means for pulse width modulating the switching circuit at the predetermined frequency such that the rectifier circuit provides a current having a flattened full wave rectified sinewave waveform.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figures 1, 3:
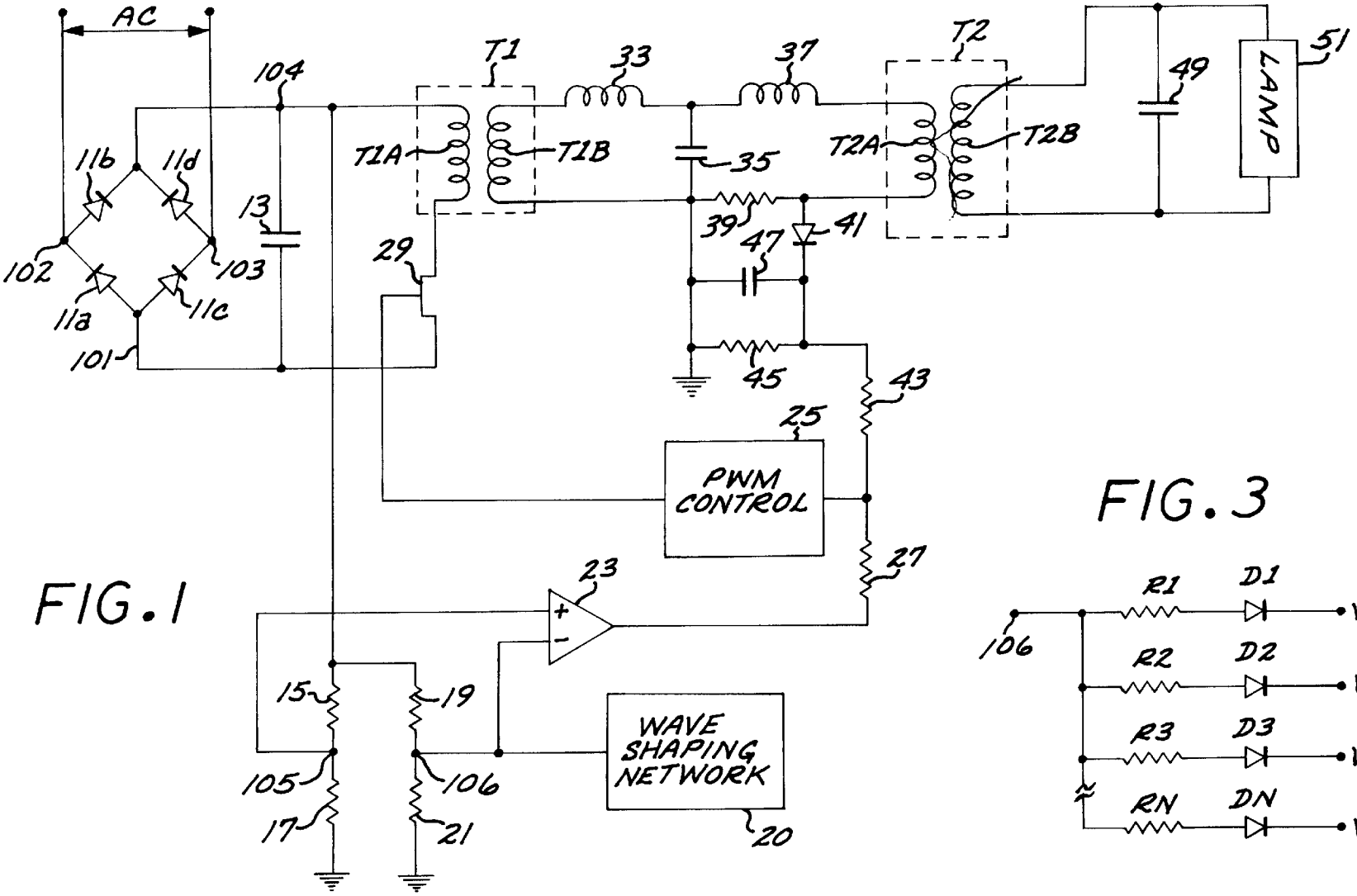
FIG. 1 is a schematic diagram of a gas discharge lamp electronic ballast circuit in accordance with the invention.
FIG. 3 is a schematic diagram of an illustrative example of a waveshaping network of the gas discharge lamp electronic ballast circuit of FIG. 1.

In the following detailed description and in the several figures of the drawing, like elements are identified with like reference numerals.

Referring now to FIG. 1, set forth therein is a schematic diagram of a gas discharge lamp electronic ballast circuit in accordance with the invention which includes a full wave rectifier bridge 11 comprised of diodes 11*a*, 11*b*, 11*c*, 11*d* arranged as a conventional rectifier circuit wherein the anode of the diode 11*a* is connected to the anode of the diode 11*c* at a node 101 which is connected to a ground reference potential, the cathode of the diode 11*a* is connected to the anode of the diode 11*b* at a node 102, the cathode of the diode 11*c* is connected to the anode of the diode 11*d* at a node 103, and the cathode of the diode 11*b* is connected to the cathode of the diode 11*d* at a node 104. Standard 60 Hz AC power is connected across the nodes 102 and 103, and a full wave rectified DC power output is provided across the nodes 101 and 104. A relatively small high frequency bypass filter capacitor 13 is connected across the nodes 102 and 104. The high frequency bypass capacitor is configured to present a relatively high impedance at 120 Hz and a relatively low impedance at the switching frequency of pulse width modulation control circuit discussed further herein. For the illustrative example of a pulse width modulation switching frequency of 25 KHz, a bypass capacitance of 0.5 microfarads would provide an impedance of 2500 ohms at 120 Hz and 10 ohms at 25 KHz. In view of the relatively high impedance of the high frequency bypass capacitor 13 at 120 Hz, the voltage across the nodes 101 and 104 is a full wave rectified sinewave having a frequency of 120 Hz. There will of course be a small amount of 25 KHz ripple across the bypass capacitor 13, but for typical operation this has no effect and does change the operation.

First and second voltage divider resistors 15, 17 are serially connected at a node 105 between the node 104 and the ground reference potential. Third and fourth voltage divider resistors 19, 21 are serially connected at a node 106 between the node 101 and 104. The resistors 15 and 19 are of identical value, and the resistors 17 and 21 are of identical value. The node 106 is further connected to a waveshaping network 20 that controls the voltage at the node 106 to be a full wave rectified sinewave having a flattened top. As discussed further herein, the waveshaping network 20 can comprise a diode-resistor ladder that incrementally connects resistive paths to the node 106 as the voltage at the node 106 increases, such that the voltage waveform at the node 106 is a flattened full wave rectified sinewave. The voltage at the node 105 follows the waveform of the full wave rectified sinewave at the node 104 but at a lower amplitude, and comprises a reference full wave rectified sinewave that is representative of the full wave rectified sinewave at the node 104.

Figure 2:
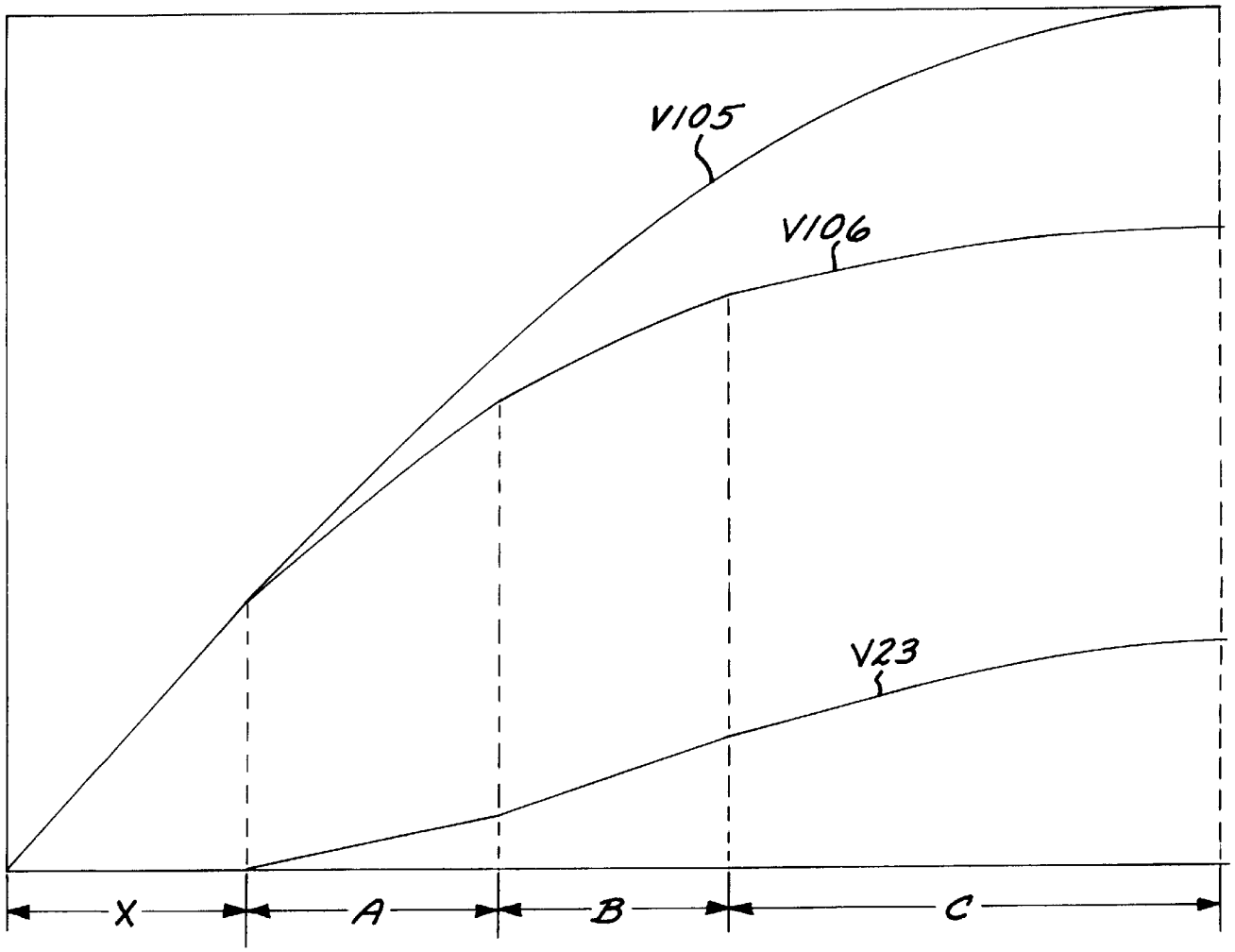
FIG. 2 illustrates waveforms of selected voltages in the gas discharge lamp electronic ballast circuit of FIG. 1.

Referring in particular to FIG. 2, schematically illustrated therein are a waveform V105 of the voltage at the node 105 and a waveform V106 of the voltage at the node 106 for a one-half of a half sinewave, and for the illustrative example wherein the rate of increase of the voltage V106 at the node 106 is decreased in three steps. During a subinterval X that begins at the start of a half sinewave, the waveshaping network 20 provides no attenuation and the voltage V106 at the node 106 follows the voltage V105 at the node 105. During a subinterval A that begins at the end of the subinterval X, the waveshaping network 20 provides a predetermined amount of attenuation, and the voltage V106 at the node 106 increases at a slower rate than the rate at which the voltage V105 at the node 105 increases. During a subinterval B that begins at the end of the subinterval A, the attenuation provided by the waveshaping network 20 is increased relative to the attenuation provided during the subinterval A, and the voltage V106 at the node 106 increases at a slower rate than during the subinterval A. During a subinterval C that begins at the end of the subinterval B, the attenuation provided by the waveshaping network 20 is increased relative to the attenuation provided during the subinterval B, and the voltage V106 at the node 106 increases at a slower rate than during the subinterval B. Thus, the voltage V106 at the node 106 comprises a waveform that increases at progressively slower rates as the amplitude of the voltage V105 at the node increases in a sinusoidal manner.

The node 105 is connected to the non-inverting input of a differential amplifier 23 having its non-inverting input connected to the node 105. The output of the differential amplifier 23 therefore comprises the difference between the reference full wave rectified sinewave at the node 105 and the flattened full wave rectified sinewave at the node 106. In particular, for a full wave rectified sinewave having a period T, wherein T is the time interval from the start of a half sinewave to the start of the next half sinewave, the difference is zero at the start of a period, increases as the half sinewave increases in amplitude, reaches a maximum at T/2, and then decreases as the half sinewave decreases in amplitude. FIG. 2 illustrates a waveform V23 of the voltage output of the differential amplifier 23 for one half of a half sinewave.

The output of the differential amplifier 23 is coupled to via a resistor 27 to a DC feedback input of a pulse width modulation (PWM) control circuit 25 that for example operates at a switching frequency of 25 KHz. By way of illustrative example, the pulse width modulator control circuit 25 comprises a Unitrode Corporation UC3524B integrated circuit. An FET gate control output of the PWM control circuit 25 is connected to the gate of an N-channel transistor 29. The source of the N-channel transistor 29 is connected to the ground reference potential, and the drain of the N-channel transistor 29 is connected to one terminal of a primary winding T1A of a transformer T1. The other terminal of the primary winding T1A of the transformer T1 is connected to the node 104.

A secondary winding T1B of the transformer is connected to a matching network that includes an inductor 33, a capacitor 35 and an inductor 37. One terminal of the inductor 33 is connected to one terminal of the secondary winding T1B, and the other terminal of the secondary winding T1B is connected to the ground reference potential. The other terminal of the inductor 33 is connected to one terminal of the capacitor 35 and one terminal of the inductor 37. The other terminal of the capacitor 35 is connected to the ground reference potential, while the other terminal of the inductor 37 is connected to a primary winding T2A of a transformer T2.

The other terminal of the primary winding T2A of the transformer T2 is connected to one terminal of a sense resistor 39 which has its other terminal connected to the ground reference potential. The non-grounded terminal of the sense resistor 39 is further connected to the anode of a diode 41 which has its cathode coupled to the DC feedback input of the PWM control circuit 25 via a resistor 43. A resistor 45 and a capacitor 47 are connected in parallel between the cathode of the diode 41 and the ground reference potential.

A capacitor 49 and a fluorescent lamp 51 are connected in parallel across a secondary winding T2A of the transformer T2. The secondary winding T2A and the capacitor 49 are tuned to the switching frequency of the pulse width modulation control circuit 25.

In operation, the voltage across the primary winding T1A of the transformer comprises a series of pulses having an amplitude that is modulated by the amplitude of the full wave rectified sinewave across the nodes 104 and 101. The width of the voltage pulses is controlled by (a) voltage at the cathode of the diode 41 which represents the long term average of the peaks of the lamp current as sensed by the sense resistor 39, the diode 41, the resistor 45 and the capacitor 47, as described more fully herein, and (b) the difference between the reference full wave rectified sinewave voltage at the node 105 and the full wave rectified flattened sinewave voltage at the node 106. The current through the N-channel transistor 29 and the primary winding T1A comprises a series of spaced apart ramps, each ramp starting when the N-channel transistor 29 is turned on and ending when the N-channel transistor 29 is subsequently turned off, and each ramp having a slope that proportional to voltage. In other words, during each pulse applied to the gate of the N-channel transistor 29, the current through the N-channel transistor 29 and the primary winding T1A comprises a ramp having a slope that is determined by the voltage at the node 104. As described further herein, the width of the voltage pulses across the primary winding T1A is modulated such that the envelope of the current ramp peaks comprises a flattened full wave rectified sinusoid.

The output of the secondary winding T1B of the transformer T1 comprises a series of pulses that vary in amplitude with the input AC voltage waveform and vary in width as determined by the widths of the current ramps in the primary winding T1A. The matching network comprised of the inductor 33, the capacitor 35 and the inductor 37 provides across the primary winding T2A of the transformer winding T2 a near sinusoidal voltage having a frequency that is equal to the pulse width modulation switching frequency of 25 KHz. The secondary winding T2B of the transformer T2, the capacitor 49, and the lamp form a resonant lamp circuit such that the lamp 51 is driven with a sinusoidal voltage having a frequency that is equal to the pulse width modulation switching frequency of 25 KHz. The K or coupling factor from the primary winding T2A to the second winding T2B allows the lamp current to have a good sinusoidal waveform. The voltage across the primary winding T2A will typically have some distortion due to the pulses from the matching network comprised of inductor 33, capacitor 35 and inductor 37, but with a loose coupling factor such as0.9 and good Q factor for the resonant lamp circuit, the lamp current will have low distortion at 25 KHz and some amount of 120 Hz amplitude modulation from the flattened current envelope in the secondary winding T1B of the transformer T1.

More particularly as to the pulse width modulation of the voltage pulses applied to the primary winding T1A of the transformer, the width of the pulses is controlled by the sum of (a) the voltage at the cathode of the diode 41 which represents the long term average of the peaks of the lamp current as sensed by the sense resistor 39, the diode 41, the resistor 45 and the capacitor 47, and (b) the difference between the full wave rectified sinewave voltage at the node 105 and the full wave rectified flattened sinewave voltage at the node 106, wherein the sum of the voltages is represented by the sum of the currents at the DC feedback input of the PWM control circuit as provided by the resistors 27 and 43. In particular, pulse width changes inversely with the current sum provided by the resistors 27 and 43. Thus, the pulse width of the pulses provided to the gate of the N-channel transistor 29 is determined by modulation of a desired long term average current level, as defined by the value of the resistor 43, with the output of the differential amplifier 23 which varies with the amplitude of the full wave rectified sinewave at the node 104.

Considering now the operation of the pulse width modulation of the N-channel transistor switch 29 for situation wherein the average of the peaks of the current to the lamp resonant circuit (comprised of the secondary winding T2B, the capacitor 49 and the lamp 51) is substantially constant, the widths of the pulses provided to the gate of the N-channel transistor 29 therefore decrease with increasing amplitude of the full wave rectified sinewave voltage, and the intervals during which the N-channel transistor 29 is conductive decrease with increasing amplitude of the full wave rectified sinewave. The slopes of the current ramps through the N-channel transistor 47 and the primary winding T1A increase with increasing amplitude of the full wave rectified sinewave voltage, and in accordance with the invention the waveshaping network 20 and the resistor 27 are configured such that the peaks of the current ramps that flow through the N-channel transistor 29 and the primary winding T1A follow a flattened full wave rectified sinewave. In other words, the envelope of the peaks of the current ramps follows a flattened full wave rectified sinewave. As a result of the high frequency filtering provided by the bypass capacitor 13 which presents a relatively low impedance at the 25 KHz pulse width modulation switching frequency, the waveform of the current flowing out of the rectifier bridge 11 comprises a flattened full wave rectified sinewave having the same frequency of 120 Hz and the same phase as the full wave rectified sinewave voltage at the node 104, with a peak amplitude that is less than the peak amplitude of the envelope of the peaks of the current ramps through the N-channel transistor 29 and the primary winding T1A.

Considering further the effect of variation in the average of the peaks of the current to the lamp resonant circuit as represented by the current through the resistor 43, change in the average of the peaks of the current to the lamp resonant circuit will change the peak amplitude of the flattened full wave rectified sinewave current flowing from the bridge rectifier 11. However, in view of the output of the differential amplifier 29, such peak amplitude will always be less than a full wave rectified sinewave current that would otherwise flow from the rectifier bridge 11 if the pulse width of the gate control output of the pulse width modulation circuit 25 were constant.

Thus, since the current flowing from the bridge rectifier 11 comprises a flattened full wave rectified sinewave that follows the full wave rectified sinewave voltage at the node 104, the circuit of FIG. 1 achieves an improved power factor. The peaks of current to the bypass capacitor 13 are not as great as would otherwise occur if the capacitor were large enough to hold the voltage to near the maximum amplitude from one cycle to the next. The crest factor without shaping of the input current as described above would be high since the lamp 51 tends to be a constant voltage device, and the unflattened current peaks would cause very large current to flow in the lamp. But with the shaping of the input current as described above, the flattened current envelope into the matching network, and the loose coupling to the resonant lamp circuit, the crest factor is greatly improved with minimum parts and cost.

Referring now to FIG. 3, set forth therein is a schematic diagram of a waveshaping network that can be implemented as the waveshaping network of 20 of FIG. 1. The waveshaping network of FIG. 3 includes a plurality of diodes D1 through DN, each having its respective anode coupled to the node 106 of FIG. 1 via respective resistors R1 through RN. The cathodes of the diodes D1 through DN are respectively connected to respective voltages V1 through VN. By way of illustrative example, the resistors R1 through RN are of identical value. The voltages V1 through VN are of increasing voltages that are less than the maximum amplitude of the reference full wave rectified sinewave voltage at the node 105. Thus, for example, the voltage V1 is the lowest voltage and is greater than the minimum amplitude of the reference full wave rectified sinewave voltage at the node 105. The voltage V2 is greater than the voltage V1, and so forth to the voltage VN.

The waveshaping network of FIG. 3 operates as follows for a cycle or half sinewave of the full wave rectified sinewave on the node 104. As the half sine wave voltage on the node 104 increases, the diode resistor circuits D1, R1 through DN, RN successively become conductive, and the rate of increase of the voltage on the node 106 is successively reduced as the voltage at the node 106 successively reaches the respective voltages of V1 plus a diode drop, V2 plus a diode drop, and so forth to VN plus a diode drop. As the half sinewave at the node 104 decreases, the diode resistor circuits DN, RN through D1, R1 successively become non-conductive, and the rate of decrease of the voltage at the node 106 is successively increased as the voltage at the node 106 reaches the voltages of VN plus a diode drop, VN-1 plus a diode drop, and so forth to V1 plus a diode drop.

Thus, the foregoing has been a disclosure of a unique gas discharge lamp electronic ballast circuit that provides for improved power factor, reduced crest factor, and high lamp efficiency with a reduced parts count Although the foregoing has been a description and illustration of specific embodiments of the invention, various modifications and changes thereto can be made by persons skilled in the art without departing from the scope and spirit of the invention as defined by the following claims.

What is claimed is:

1. A gas discharge lamp electronic ballast circuit, comprising:

a gas discharge lamp;

rectifier responsive to AC power for providing a full wave rectified sinewave voltage across output terminals of said rectifier means;

a transformer having a primary winding and a secondary winding;

switching means for repetitively connecting said rectifying means full wave rectified sinewave voltage to said primary winding;

driving means responsive to said secondary winding for driving said lamp with a sinusoidal voltage having a predetermined frequency;

current sensing means for sensing an average of peaks of current flowing in said driving means;

reference means responsive to said rectifier means for providing a reference full wave rectified sinewave voltage;

waveshaping means responsive to said rectifier means for providing a flattened full wave rectified sinewave voltage that is in phase with said reference full wave rectified sinewave voltage, wherein a difference between said reference full wave rectified sinewave voltage and said flattened full wave rectified sinewave voltage increases with the amplitude of said reference full wave rectified sinewave voltage;

difference means responsive to said reference full wave rectified sinewave voltage and said flattened full wave rectified sinewave voltage for providing a difference means output that is indicative of the difference between said reference full wave rectified sinewave voltage and said flattened full wave rectified sinewave voltage; and pulse width modulation control means responsive to said difference means and said current sensing means for pulse width modulating said switching means at said predetermined frequency so that said rectifier means provides a current having a flattened full wave rectified sinewave waveform.

2. The gas discharge lamp electronic ballast circuit of claim 1 wherein said rectifying means includes a bypass capacitor.

3. The gas discharge lamp electronic ballast circuit of claim 1 wherein said AC power is standard 60 Hz AC power, and wherein said pulse width modulation means operates at 25 KHz.

4. The gas discharge lamp electronic ballast circuit of claim 1 wherein said rectifying means includes a bypass capacitor that provides a relatively high impedance at 60 Hz and a relatively low impedance at 25 KHz.

* * * * *